US012448846B2

(12) United States Patent
Strange

(10) Patent No.: US 12,448,846 B2
(45) Date of Patent: Oct. 21, 2025

(54) CENTRE BYPASS MUD HAMMER

(71) Applicant: GOOD WATER HOLDINGS PTY LTD, CLAREMONT (AU)

(72) Inventor: Warren Ross Strange, Claremont (AU)

(73) Assignee: GOOD WATER HOLDINGS PTY LTD., Western Australia (AU)

( * ) Notice: Subject to any disclaimer, the term of this patent is extended or adjusted under 35 U.S.C. 154(b) by 0 days.

(21) Appl. No.: 18/029,935

(22) PCT Filed: Sep. 22, 2021

(86) PCT No.: PCT/AU2021/051105
§ 371 (c)(1),
(2) Date: Apr. 3, 2023

(87) PCT Pub. No.: WO2022/067376
PCT Pub. Date: Apr. 7, 2022

(65) Prior Publication Data

US 2023/0374861 A1 Nov. 23, 2023

(30) Foreign Application Priority Data

Oct. 2, 2020 (AU) ..... 2020903569

(51) Int. Cl.
*E21B 4/14* (2006.01)
*E21B 21/08* (2006.01)
*E21B 21/10* (2006.01)

(52) U.S. Cl.
CPC ..... *E21B 4/14* (2013.01); *E21B 21/08* (2013.01); *E21B 21/10* (2013.01)

(58) Field of Classification Search
CPC ..... E21B 4/14; E21B 21/10; E21B 21/08
See application file for complete search history.

(56) References Cited

U.S. PATENT DOCUMENTS 4,106,571 A * 8/1978 Stone ..... E21B 4/14 173/64
4,133,393 A 1/1979 Richards
(Continued)

FOREIGN PATENT DOCUMENTS

DE 102017005548 A1 12/2018

OTHER PUBLICATIONS

International Search Report for related International Application No. PCT/AU2021/051105; action dated Apr. 7, 2022; (4 pages).
(Continued)

*Primary Examiner* — Robert E Fuller
(74) *Attorney, Agent, or Firm* — K&L Gates LLP

(57) ABSTRACT

A mud hammer including a piston barrel including at least one exhaust port configured to receive a single flow of drilling fluid including drilling mud, a piston positioned within the piston barrel and configured to move in a reciprocating motion operated by a first portion of the drilling fluid, a bypass tube disposed through the piston and in fluid communication with a drill bit, an adjustable valving set configured to divert a second portion of the drilling fluid into the bypass tube, and a wear sleeve positioned to prevent contact between the piston and the piston barrel. The second portion of the drilling fluid is diverted into the bypass tube is exhausted from the drill bit and the first portion of drilling fluid is exhausted from the piston barrel via the exhaust port, in a direction away from the drill bit.

24 Claims, 4 Drawing Sheets

(56) References Cited

U.S. PATENT DOCUMENTS

| | | | |
|---|---|---|---|
| 5,396,965 | A | 3/1995 | Hall et al. |
| 2015/0129308 | A1 | 5/2015 | Harrington et al. |

OTHER PUBLICATIONS

Written Opinion for related International Application No. PCT/AU2021/051105; action dated Apr. 7, 2022; (6 pages).

* cited by examiner

CENTRE BYPASS MUD HAMMER

CROSS-REFERENCE TO RELATED APPLICATIONS

This application is the National Stage filing under 35 U.S.C. 371 of International Application No. PCT/AU2021/051105, filed on Sep. 22, 2021, which claims the benefit of earlier filing date and right of priority to Australian Application No. 2020903569 filed on Oct. 2, 2020, the contents of which are all hereby incorporated by reference herein in their entirety.

FIELD

The disclosure is directed to a fluid or mud hammer, mud hammer system and method for drilling in deep wells.

BACKGROUND

As demand for new emission free, renewable, baseload geothermal energy supplies has increased, operators have been forced to drill deeper to find sufficient heat for thermal energy production. Much of the higher cost of drilling deeper, especially onshore, is typically associated with decreased rate of penetration (ROP) caused by both harder rock and higher mud weights required to counter the harder rock, over-pressured reservoirs, and higher static pressures often associated with deeper drilling. Typical mud rotary drilling methods may have less than desired performance metrics in hard rock formations. For instance, typical mud rotary drilling methods may have a slower drilling rate and shorter drill bit lifetime than is desired, which increases operational costs in hard rock formations. Percussion drilling systems, combining a fluid or mud hammer with drill bits, have been developed in an attempt to increase drilling performances in hard formations.

Fluid or mud hammer systems convert a portion of the power resident in the drilling fluid to mechanical force that drives the drill bit into the formation. Percussion forces from the piston movement striking the drill bit may improve the rate of penetration in hard rock by more than 500%; however, mud additives in the drilling fluid required for well control and drill cutting transport to the surface cause a high wear rate on the moving parts of a fluid hammer. This high wear rate on the working components and the limited amount of fluid that can be pumped through a typical fluid hammer to clear drilled cuttings from the bottom of the well are significant drawbacks to typical fluid hammer systems that have been prohibitive to their use for deep well drilling. Accordingly, rotary tricone drilling methods are generally still the only method used. The low penetration rates and high costs of the typical rotary tricone method, however, are at least in part preventing the development of geothermal energy production in most countries where deep hard rock wells are required to reach the required geothermal heat levels for electricity generation, desalination, heating, cooling and waste water treatment.

One typical fluid hammer system is a Dual Circulation water or fluid hammer ("DC fluid hammer"), such as the one disclosed in U.S. Patent Application Publication No. 2018/0044991A1. A DC fluid hammer uses a dual circulation drill pipe system to separate drilling mud from clean water. The clean water, normally injected into the annulus of a drill pipe, is pumped under pressure to operate the water hammer. This clean water operation may contribute to longer operation periods between servicing and rebuilding the DC fluid hammer. The drilling mud is required to have a high viscosity as operators drill deeper wells so that drill cuttings can be transported to the surface and formation fluids, including high gas pressure, are prevented from entering the well. The high viscosity drilling mud is typically pumped into an inner tube of a drill pipe system and delivered through an inner tube passing through the DC fluid hammer to the DC fluid hammer's drill bit face. This keeps the mud from passing through the DC fluid hammer's working components, which would wear out the components. Both the clean water and the drilling mud mix together after exiting the DC fluid hammer and push the drill cuttings to the surface.

Typical DC fluid hammers, however, have a number of drawbacks. It has been found that a DC fluid hammer wears out more quickly than desired and fails to perform for required periods of time when drilling deep wells with drilling muds. For instance, it has been found that the clean water passing through the DC fluid hammer's working components still wears out the components.

Another drawback of a typical DC fluid hammer for drilling deep wells is the high amount of mud loss. When the total mixed flow exits the well with the drill cuttings, a percentage of the total fluid has to be cleaned at the surface to between about three and ten microns before it can be pumped under pressure down the pipe to operate the DC fluid hammer. This is typically around 20 to 50% of the total fluid volume delivered under pressure down the drill pipe. The mud and drilling additives that are taken out of this percentage of the total fluid have to be added back to the drilling mud fluid that is pumped down the DC's hammer's inner tube to be mixed with the clean water exhausted from the hammer at the bottom of the well. The amount of mud that must be replaced can be large and may create prohibitively high operational costs for the DC fluid hammer that may be greater than replacing the entire DC fluid hammer itself every day of operation.

A further drawback of the typical DC fluid hammer is that its operation requires a dual circulation drill pipe so that the DC fluid hammer may receive two separate flows from the dual circulation drill pipe. One flow is clean water and one flow contains drilling muds and additives. The clean flow operates the hammer and the drilling mud is channeled to the drill bit face. A dual circulation drill pipe, however, increases the complexity of operating the drilling system, at least because a dual circulation drill pipe is not American Petroleum Institute (API) certified.

Operating a drilling system using a drill pipe that is not API certified may increase the risk of injury or damage to equipment, such as to the inner tube that is used to deliver mud to the bottom of the well, and accordingly such a system does not provide suitable safety levels. For example, in at least some instances it is mechanically difficult or even impossible to include typical internal blow out prevention (IBOP) with a drill pipe that is not API certified, such as with a dual circulation drill pipe. As known to one of skill in the art, an IBOP may be a sub that sits below a top drive and may be turned off remotely or by hand in the event of an emergency or blow out. Without the IBOP, the inner tube that delivers mud to the bottom of the well provides an unrestricted and unchecked pathway for dangerous gas blow out to the well's surface. In addition, it is difficult or even impossible to add an internal safety system to the inner tube. Operating a drilling system without an API certified drill pipe also increases drilling system's operational costs (e.g., some insurance companies will not provide well insurance unless the driller is using certified API drilling pipe and safety systems amid the safety concerns of not doing so). Accordingly, typical operators do not use drill piping that is not API certified, thus decreasing the DC fluid hammer's utility.

An additional drawback of at least some typical mud hammers is what may be termed re-grinding. Re-grinding refers to a drill bit re-drilling, pounding, and grinding the same rock material over and over until it is a paste because the rock that is being drilled is not flushed away from the drill bit face. This is due to the limit on the fluid volume that can be pushed through the working parts of a typical fluid, water or mud hammer and exhausted through the drill bit ports. The result is a very slow drilling production or speed and premature failure of the drill bit. For instance, as an example, re-grinding may cause water, fluid or mud hammer drill bits to fail in just 20 meters (65.6 feet) when they should last for 400 meters (1312.3 feet) or more.

By diverting drilling mud to the drill bit face, the typical DC fluid hammer helps increase flushing and decrease re-grinding. Operation of the typical DC fluid hammer, however, may result in too much fluid or mud (e.g., 70 to 80% of the total fluid volume) being delivered to the drill bit face. It has been found that a cushion of high pressure fluid may form under the drill bit when too much fluid or mud is delivered to the drill bit face, which reduced the typical DC fluid hammer's production levels significantly. It has also been found that reducing mud flow through the typical DC fluid hammer's inner tube in an attempt to solve the high pressure fluid cushion problem resulted in a total drilling fluid volume that was insufficient to lift or transport the drill cuttings to the surface. As a result, it was found that a bypass sub had to be fitted above the DC fluid hammer and above the typical water, fluid or mud hammer in order to deliver sufficient volumes of mud into the well to lift the drill cuttings to the surface. The high volume flowing from the bypass sub above the hammers restricts the flow coming from below that is trying to transport the drill cuttings. In addition, at least some typical fluid, water, mud or DC fluid hammers are limited to flow or operate with only 20% of the total well volume, which is around 200 to 300 gallons per minute on a 12-inch version (in diameter) (30.48 cm) of a DC fluid hammer. This is far below the total well volume which would be around 1,000 gallons per minute to drill a 12.5" diameter well below a 5,000 meter depth.

Accordingly, a mud hammer drilling system that solves at least the above drawbacks is desired.

SUMMARY

The present disclosure is generally related to a mud hammer, a mud hammer system, and method for safe and viable percussion drilling in deep wells with improved efficiency over typical fluid, mud, and water hammers.

The term "tripping pipe" or "making a trip", is understood to describe the physical actions of removing or pulling a drill string out of a bore, to make adjustments or replace exhausted componentry, and then running the drill string back into the bore.

In a first aspect, the disclosure provides a mud hammer comprising: a piston barrel configured to receive a single flow of drilling fluid including drilling mud, the piston barrel including at least one exhaust port exhausting drilling fluid to an exterior of the mud hammer; a piston positioned within the piston barrel and configured to move in a reciprocating motion operated by a first portion of the drilling fluid; a bypass tube disposed through the piston and in fluid communication with a percussion drill bit; an adjustable valving set configured to divert a second portion of the drilling fluid into the bypass tube; and a wear sleeve positioned to prevent contact between the piston and the piston barrel; wherein the second portion of the drilling fluid diverted into the bypass tube is exhausted from the drill bit and the first portion of drilling fluid operating the piston is exhausted from the piston barrel via the exhaust port, away from the drill bit.

In one embodiment, there is provided a mud hammer configured to operate with drilling fluid that includes drilling mud includes a piston barrel. A piston is positioned within the piston barrel and is configured to move in a reciprocating motion having a piston stroke length. A bypass tube is positioned through the piston. A valving set is configured to allow a set amount of fluid to flow into the bypass tube. A wear sleeve is positioned to prevent contact between the piston and the piston barrel. A drill bit is in fluid communication with the bypass tube.

In a second aspect, the disclosure provides a system comprising: a single flow drill pipe configured to deliver a single flow of drilling fluid including drilling mud; a mud hammer in fluid communication with the single flow drill pipe, the mud hammer including: a piston barrel including at least one exhaust port exhausting drilling fluid to an exterior of the mud hammer; a piston positioned within the piston barrel and configured to move in a reciprocating motion operated by a first portion of the drilling fluid; a bypass tube disposed through the piston and in fluid communication with a percussion drill bit; an adjustable valving set configured to divert a second portion of the drilling fluid into the bypass tube; and a wear sleeve positioned to prevent contact between the piston and the piston barrel, wherein the second portion of the drilling fluid diverted into the bypass tube is exhausted from the drill bit and the first portion of drilling fluid operating the piston is exhausted from the piston barrel via the exhaust ports, away from the drill bit.

In one embodiment, there is provided a system includes a single flow drill pipe configured to deliver a single flow of drilling fluid including drilling mud. The system may also include a mud hammer in fluid communication with the single flow drill pipe. The mud hammer is configured to operate with drilling fluid that includes drilling mud and includes a piston barrel. A piston is positioned within the piston barrel and is configured to move in a reciprocating motion having a piston stroke length. A bypass tube is positioned through the piston. A valving set is configured to allow a set amount of fluid to flow into the bypass tube. A wear sleeve is positioned to prevent contact between the piston and the piston barrel. A drill bit is in fluid communication with the bypass tube.

In a third aspect, the disclosure provides a method for drilling, comprising: positioning a mud hammer in a drilling well, the mud hammer including: a piston barrel including at least one exhaust port configured to exhaust drilling fluid to an exterior of the mud hammer; a piston positioned within the piston barrel and configured to move in a reciprocating motion operated by a first portion of a drilling fluid; a bypass tube disposed through the piston and in fluid communication with a percussion drill bit, the drill bit having a drill bit face; an adjustable valving set configured to divert a second portion of the drilling fluid into the bypass tube; a wear sleeve positioned to prevent contact between the piston and the piston barrel; directing a single flow of drilling fluid to the mud hammer via a single flow drill pipe, the drilling fluid including drilling mud; and operating the mud hammer to drill in the drilling well, wherein the second portion of the drilling fluid diverted into the bypass tube is exhausted from the drill bit at the drill bit face and the first portion of drilling fluid operating the piston is exhausted from the piston barrel via the at least one exhaust port, away from the drill bit.

In one embodiment a method includes positioning a mud hammer in a drilling well. The mud hammer is configured to operate with drilling fluid that includes drilling mud and includes a piston barrel. A piston is positioned within the piston barrel and is configured to move in a reciprocating motion having a piston stroke length. A bypass tube is positioned through the piston. A valving set is configured to allow a set amount of fluid to flow into the bypass tube. The set amount of fluid that flows into the bypass tube includes a first portion of the drilling mud in the drilling fluid. A second portion of the drilling mud in the drilling fluid flows into the mud hammer, exteriorly to the bypass tube, to operate the mud hammer. A wear sleeve is positioned to prevent contact between the piston and the piston barrel. A drill bit is in fluid communication with the bypass tube, the drill bit having a drill bit face. A single flow of drilling fluid is directed to the mud hammer via a single flow drill pipe, the drilling fluid including drilling mud. The mud hammer is operated to drill in the drilling well. The first portion of the drilling mud exits the mud hammer at the drill bit face.

DETAILED DESCRIPTION

Figure 1:
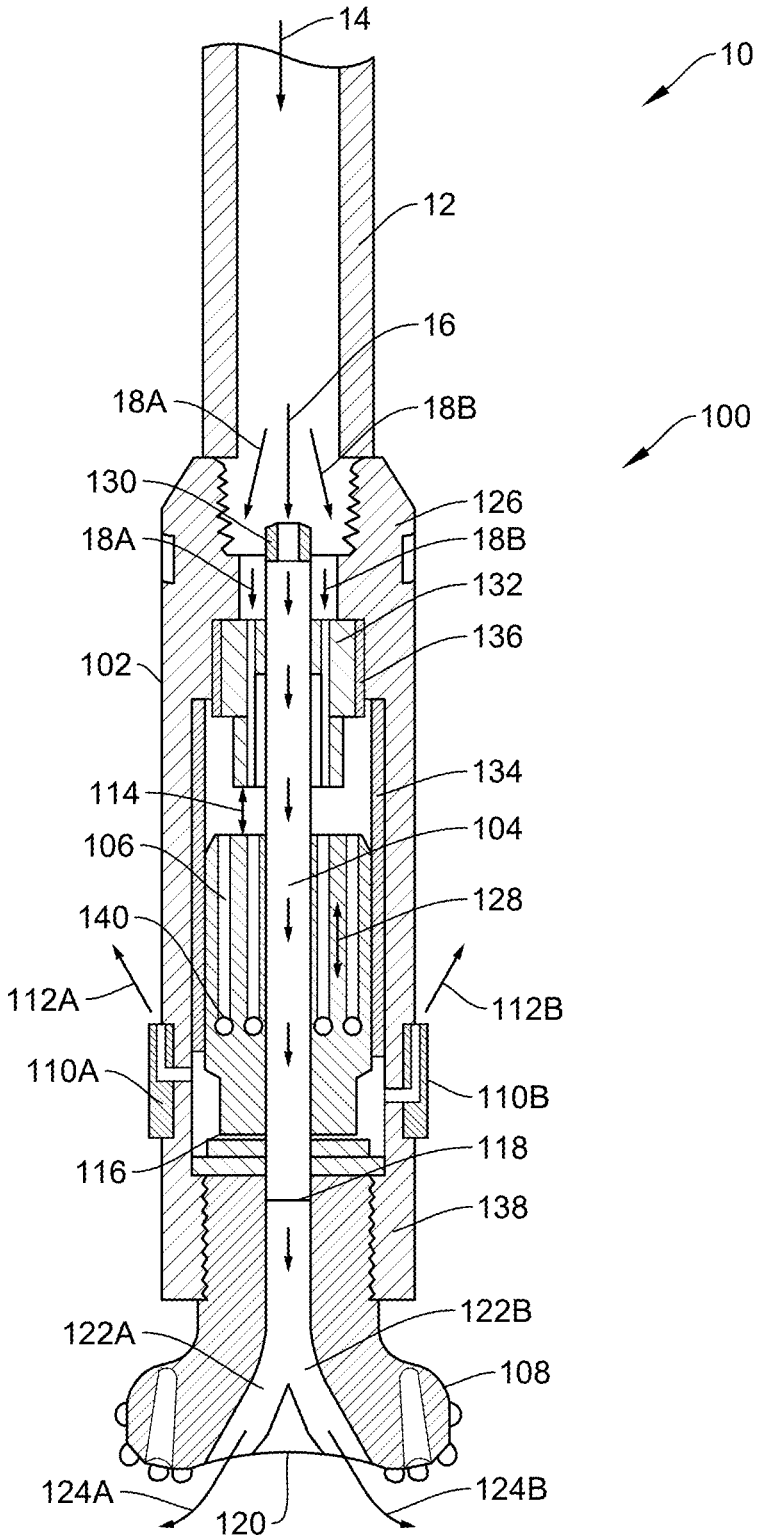
FIG. 1 illustrates a cross-sectional view of a drilling system, according to an aspect of the present disclosure.

The term "sub" as used herein is understood to refer to a substructure. This is a general term afforded to many small components of a drill string, for example a short drill collar, a crossover, a float sub, a lift sub, a bit sub, an entry sub and a circulating sub.

The present disclosure is directed to a mud hammer 100, 200 with an increased lifetime and performance as compared to typical fluid or mud hammers. For example, the provided mud hammer may have an increased lifetime and performance for deep well drilling as compared to typical fluid or mud hammers. In another example, the provided mud hammer may have an increased lifetime and performance for drilling in hard rock formations as compared to typical fluid or mud hammers. The provided mud hammer is constructed to operate with higher viscosity fluids (e.g. 50 microns) and is operated by drilling fluid including drilling mud (e.g., instead of clean water as in the design of the DC Fluid Hammer). For example, the provided mud hammer may include greater clearances between its components than at least some typical fluid hammers to enable the provided mud hammer's operation by drilling fluid.

A single flow of drilling fluid 14 is be delivered to the mud hammer 100 via a standard single flow drill pipe 12. Typical single flow drill pipes are API certified, thus increasing the safety and ease of use for the provided mud hammer as compared to a typical mud hammer (e.g., the DC fluid hammer) that is used with other non-approved types of drill pipes, such as a dual circulation drill pipe, which are not API certified. For instance, internal blow out prevention (IBOP) can be used with the mud hammer 100. Additionally, operating the mud hammer with drilling fluid does not result in the high degree of mud loss experienced with a typical DC fluid hammer since finely filtered water is not required for the mud hammer 100, as compared to a typical DC fluid hammer's operation.

The provided mud hammer 100,200 includes a piston 106 that moves in a reciprocating motion within a piston barrel 102 of the mud hammer. A valving set 132 controls the flow of drilling fluid within the mud hammer 100 to generate the piston's movement. In such instances, the valving set 132 that generates the piston's movement also moves in a reciprocating motion. One drawback of operating a mud hammer with drilling mud is that the drilling mud tends to wear out these moving components more quickly than desired during the mud hammer's operation (e.g., one of the problems that a DC fluid hammer attempts to solve).

To help combat the durability issues presented by the drilling mud, the mud hammer 100 can include a wear sleeve 134 that prevents or at least reduces contact between the mud hammer's piston barrel 102 and the piston 106. In some embodiments, the mud hammer can include a secondary wear sleeve 136 that prevents contact between the mud hammer's piston barrel 102 and the valving set 132 that generates the piston's movement. The one or more wear sleeves help prevent wear on the mud hammer's internal components and therefore increase the component's lifetime before needing to be replaced. The one or more wear sleeves 134,136 are replaced when the one or more wear sleeves are sufficiently degraded. For instance, the one or more wear sleeves 134,136 can be designed to last for about the same amount of time as the mud hammer's drill bit 108 is expected to last, which enables the wear sleeves 134,136 and the drill bit 108 to be replaced at the same time.

Pulling or tripping the mud hammer 100 from a well is a time consuming process, and thus replacing the one or more wear sleeves 134, 136 at the same time as replacing the drill bit 108 increases the mud hammer's operational efficiency as compared to pulling the mud hammer 100 from the well at two separates times. Additionally, the operational costs of replacing the one or more wear sleeves 134,136 can be much less (e.g., 1/10 of the cost) than the operational costs of drilling mud loss associated with typical DC fluid hammers. Accordingly, the mud hammer 100,200 provides improved efficiency and increased operational safety when compared to typical DC fluid hammers.

The mud hammer 100,200 includes a bypass tube 104 in fluid communication with the drill bit 108. Drilling fluid 14, including drilling mud, delivered to the mud hammer 100, 200 can flow through the bypass tube 104 and exit at the drill bit face 120. The bypass tube 104 thereby increases the flow of drilling mud to the drill bit's face, as compared to typical mud hammers, so that flushing at the drill bit face 120 is improved and re-grinding is limited.

A further valving set 130 is provided to control how much of the drilling fluid 14 flows into and through the bypass tube 104 (illustrated in the cross-sectional view of FIG. 1 as a central flow 16). The single flow of drilling fluid 14 is communicated to the single flow drill pipe 12, where a portion of the flow 16 is diverted to the bypass tube 104. The amount of drilling fluid diverted can be varied by selecting from a plurality of valving sets 130. When a valving set 130 having a large diameter is selected, a greater portion of the drilling fluid 14 will be directed into the bypass tube 104 and as such, a lesser volume of drilling fluid 14 is directed to operation of the piston 106 (illustrated in FIG. 1 as flows 18A, 18B). Where a valving set 130 having a small port (a diameter of for example 5 mm) is selected from the plurality of valving sets 130 a greater volume of drilling fluid 14 is directed to operation of the piston 106 and a lesser volume of drilling fluid 14 is directed to the bypass tube 104.

Reducing the size of the valving set 130 (and thereby the inlet port into the bypass tube 104) will increase the percentage of drilling fluid to be delivered to the working components of the hammer 100. At a given pressure and flow rate, for example 2,000 psi D/T at 6,000 m at 1,000 US GPM (US Gallons per minute), reducing the port size will increase the percentage of drilling fluid from 30% to 35% for example and simultaneously reduce the flow rate of drilling fluid to the drill bit face from 70% to 65%. This reduced diameter of the port of valving set 130 will increase the strength of the hammer, allowing it to deliver greater impact force with a given flow rate. As such, where the drill rig only has the capacity to deliver 1,000 GPM and increased piston strike force and/or strike rate is required to break a hard rock formation, then reducing the port size (of the inner tube) of valving set 130 is one adjustment option to improve bit life and penetration rates. An increased volume of drilling fluid 18A,18B driving the piston 106, can also provide a greater cycle rate of the piston 106. At a maximum the piston cycle rate is about 25 cycles per second. Conversely, a reduced volume of drilling fluid 18A, 18B driving the piston 106, can lower the piston cycle rate, at a minimum of about 10 cycles per second.

If the geology is softer, it can be beneficial to increase the size of the port of valving set 130 (into the bypass tube 104) such that the hammer hits with less force and the increased flow of drilling fluid to the bit face through the bypass tube 104 will assist flushing/removing of the drill cuttings where penetration rates are faster due to the softer geology. This means there will be more drill cuttings in the annulus of the well to push to the surface, so more flow to the drill bit will assist with moving this additional weight/volume of drill cuttings. It is also possible to increase the strike rate of the piston 106 by increasing the pressure and volume of the drilling fluid delivered from the drill rig pumps on the surface. This can occur without changes or adjustment of the valving set 130 (input port of the bypass tube 104). For example, if the driller wanted to increase the strike rate of the piston 106 from 18 BPS (beats per second) to 20 BPS, the driller can increase the RPM (revolutions per minute) of the mud pumps to increase the flow and pressure of the drilling fluid to the hammer 100. This adjustment can be made constantly, or intermittently, while drilling to maintain an optimum strike rate.

The valving set 130 is selected and fitted to the mud hammer before locating the mud hammer 100 in the well, and will remain in place until such time as the mud hammer is removed from the well to replace any one of the wear sleeves 134, 136 and drill bit 108. At this time, an alteration can be made to the mud hammer to adjust the valving set 130 before reinsertion into the well as to whether an increased piston cycle rate is required or an increase in drilling fluid diverted to the bypass tube 104 to flush the cuttings.

In FIG. 1 the valving set 130 is illustrated in cross-section where the single flow 14 is separated into a central flow 16 that is directed to the bypass tube 104 and an outer flow 18A, 18B. The central flow 16 enters the bypass tube 104 than runs coaxially through the secondary valving set 132 and piston 106. The flow 16 is communicated through the bypass tube 104 and expelled in a plurality of exhaust flows 124A, 124B at the drill bit face 120.

Meanwhile, the outer flow of drilling fluid 18A, 18B is channeled externally of the bypass tube 104 to valving set 132 protected by wear sleeve 136. The outer flow 18A, 18B can be forced around and/or through the piston 106 and can exit the piston barrel 102 and/or the piston 106 (via porting 140) before being ejected from the mud hammer via the exhaust ports 110A, 110B to form one or more exhaust flows 112A, 112B.

Figure 2:
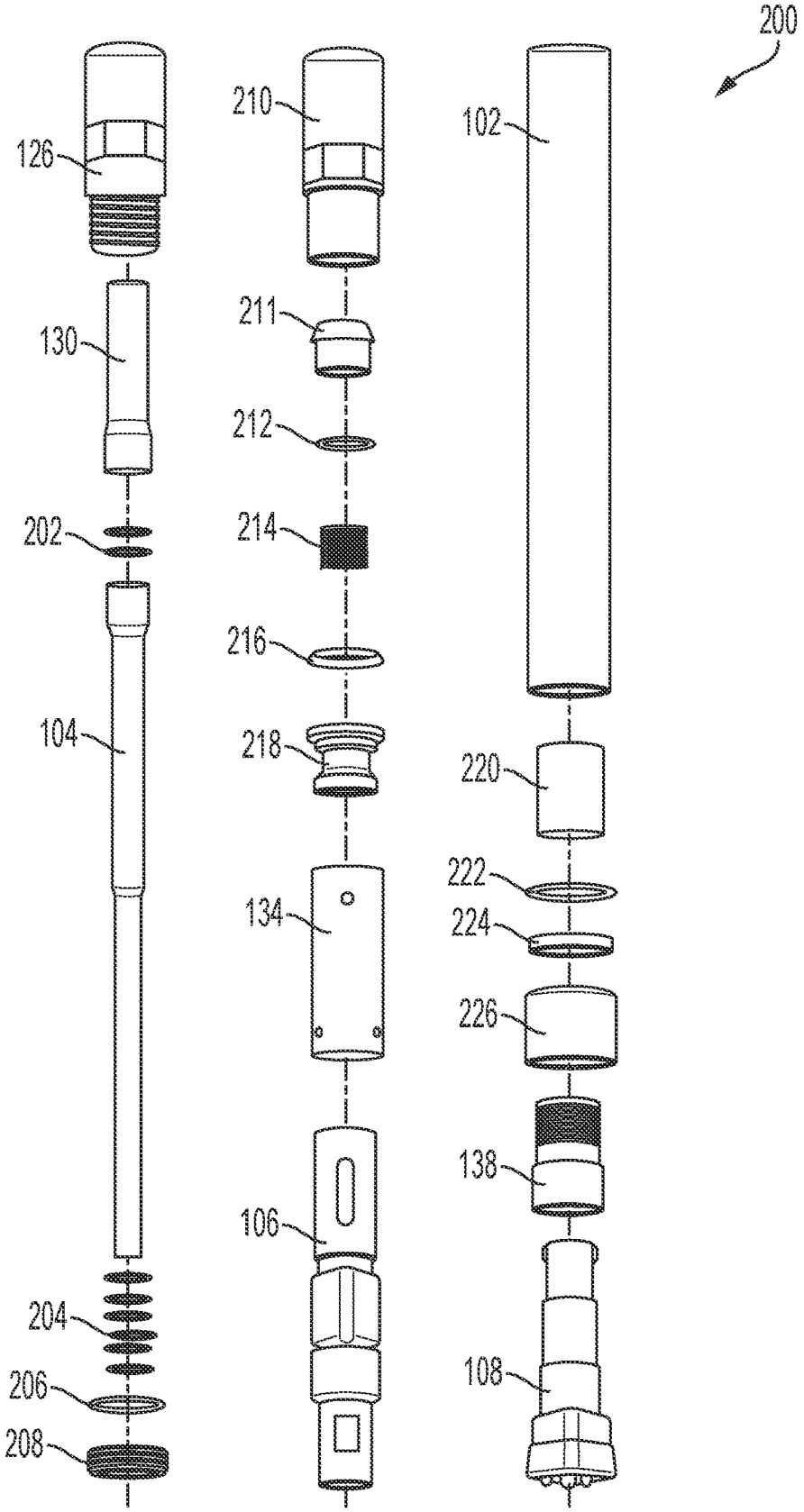
FIG. 2 illustrates an exploded view of a mud hammer, according to a further aspect of the present disclosure.

In FIG. 2, the valving set 130 is illustrated as a tube or pipe having a flared end for cooperating with a receiving end of the bypass tube 104 and encapsulating a pair of o-rings 202 between the valving set 130 and bypass tube 104. An internal diameter of the valving set 130 can be as small as 5 mm in diameter. The internal diameter of the valving set can be increased from 5 mm to 10 mm, 15 mm, 20 mm, 25 mm, 30 mm up to about 50 mm with a 12" mud hammer. The internal diameter of the valving set 130 could be increased up to about 75 mm in an 18" mud hammer.

Restricting the amount of drilling fluid 14 that is delivered to the drill bit face 120 can help prevent a high pressure cushion problem that can result when too much drilling fluid or mud is delivered to the drill bit face. The valving set 130 is selectably set to enable anywhere between 40% to 80% of the total delivered drilling fluid and mud to pass through the bypass tube 104 and be delivered to the drill bit face 120. In some embodiments, the valving set 130 can be a component of the bypass tube 104. In some embodiments, the valving set 130 can be configured such that the amount of fluid that can flow into and through the bypass tube 104 is adjustable, for example having an adjustable aperture or diaphragm to selectively increase or decrease flow therethrough. Additionally, the valving set 130 can be adjusted by pressure changes in the drilling fluid delivered. For example, the valving set 130 can be configured to open to fully at 2,000 psi and close gradually as the drilling fluid pressure is reduced. Conversely, the valving set 130 can be configured to close gradually as pressure increases.

In some embodiments, the adjustment can be provided in selecting the valving set 130 from a plurality of differently sized valving sets. In such aspects, the adjustability of the valving set 130 provides drill operators with the ability to control how much fluid flows into the bypass tube 104 based on different drilling conditions and geology. The remainder of the drilling fluid delivered to the mud hammer 100 that does not flow through the bypass tube 104 is instead pushed, under pressure, into the mud hammer 100 to operate the mud hammer. Where the valving set 130 is selected from a plurality of differently sized valving sets, the valving set 130 is selected and installed at the surface before the hammer is tripped down the well with a new drill bit 108. The valving set 130 will thus maintain a set opening, such as 30 mm, until the driller elects to adjust the valving set. The driller will select the valving set (thus making a determination on the required port size into the bypass tube 104) based on the performance of the hammer 100 over the previous 400 metres of drilling operation, and also from the condition of the last drill bit 108 which would have drilled between 300 and 1,000 m depending on the geology.

Compared to a typical water or fluid hammer that can only deliver around 200 to 400 gallons per minute (GPM) (757.1 to 1514.2 litres per minute (LPM)) in total to the drill face, the inventor has found that a 12-inch (30.48 cm) version (in diameter) of the mud hammer 100 is capable of delivering in total, around 800 to 1,000 GPM (3028.3 to 3785.4 LPM). In referencing a 12" version of the mud hammer, it is understood that the outer diameter (OD) of the hammer is 12". The 12" hammer can have a barrel diameter of about 11", such that a 12" bit can be used with the hammer; the 12" bit being one of the smallest bits which typically range from 12" to 17" for use with a 12" hammer.

In an example, this total delivery flow can include 300 GPM (1135.6 LPM) forced through the working components of the mud hammer 100 and 700 GPM (2649.8 LPM) through the bypass tube 104. This total delivery flow is about 80% to 100% of the total well volume to drill a 12.5-inch (31.75 cm) well below a 5,000 metre (16,404 feet) depth, which is an increased flow capacity over at least some typical fluid or mud hammers (e.g., 100% to 150%), as described above.

Accordingly, the mud hammer 100,200 receives the single flow of drilling fluid 14, delivers a metered portion of the drilling fluid to the drill bit face 120, and operates on the remaining portion of drilling fluid, while limiting the drilling fluid's degenerating effects on the mud hammer's internal components. Compared to typical mud rotary drilling methods, the inventor has found that the mud hammer 100 drills at faster rates (e.g., 10 metres/hour or 32.81 feet/hour compared to 300 millimetres per hour or 0.98 feet/hour) in hard rock formations. The inventor has also found that the mud hammer's drill bit 108 has a longer lifetime (e.g., 400 meters or 1312.3 feet compared to 20 meters or 65.62 feet until end of life) than a typical high-grade rotary drill bit when drilling in hard rock formations.

FIG. 1 illustrates a cross-section of a drilling system 10 in accordance with one embodiment of the disclosure. The drilling system 10 includes the single flow drill pipe 12 and the mud hammer 100. The single flow drill pipe 12 can be any suitable, standard API-certified drill pipe. The single flow drill pipe 12 can be coupled to the mud hammer 100. For example, the single flow drill pipe 12 can include a male threaded portion that couples to a female threaded portion at one end of the mud hammer 100. The flow 14 of drilling fluid can be delivered to the mud hammer 100 through the single flow drill pipe 12. The drilling fluid includes drilling mud and various additives as will be appreciated by one having skill in the art.

A body of the mud hammer 100 can be comprised of a plurality of components. Such components can include one or more of a piston barrel 102, a top sub 126, a drive sub 138, and/or other suitable components such as one or more components illustrated in the exploded view of example mud hammer 200 in FIG. 2. The mud hammer 100 includes the piston 106. The piston 106 is positioned within the piston barrel 102. The piston 106 is configured to translate in a reciprocating motion in the direction of the double-side arrow 128 of FIG. 1. The reciprocating motion of the piston 106 defines a piston stroke length designated by the double-side arrow 114 of FIG. 1. In various instances, the piston 106 can cycle in the reciprocating motion at a rate of about 10 to 25 cycles per second when a desired fluid or mud pressure for drilling operations is delivered to the mud hammer 100. A cycle is completed when the piston 106 returns to a starting position after translating two piston stroke lengths. In some instances, the piston 106 can be controlled to cycle at lower rates than 10 to 25 cycles per second by lowering a pressure at which the fluid or mud is delivered to the mud hammer 100. Conversely, the piston cycle rates can be increased with an increase of pressure of the fluid or mud delivered to the mud hammer 100. In some embodiments, the stroke length can be between about 20 to 60 millimetres (0.79 to 2.36 inches). In at least some examples, the piston stroke length can be about 40 mm (1.57 inches).

In some aspects, as the piston 106 moves, it strikes the drill bit 108 at an interface 116 on one end of the piston 106. On an opposing end, the piston 106 strikes the valving set 132, in some examples, such as the one illustrated. In other examples, the valving set 132 can be positioned on the opposite end of the piston 106 than is illustrated. In some embodiments, the valving set 132 can be positioned around the piston 106. The valving set 132 is configured to generate movement of the piston 106 as will be appreciated by one having skill in the art. The valving set 132 can include a single valve or can include multiple valves or other suitable components, in various instances. In some instances, the valving set 132 can include one or more check valves and/or plungers. In other aspects, the piston 106 can include porting 140 instead of or in addition to the valving set 132. The porting 140 can be configured to generate movement of the piston 106. The valving set 132 can be adjustable in having a variable aperture or diaphragm therein that controls the amount of drilling fluid that can pass therethrough. In some embodiments the valving set 132 is one of a plurality of valving sets 132 that can be selected from a range of valve diameters.

In various aspects, the mud hammer 100 includes the wear sleeve 134 positioned between the piston 106 and the piston barrel 102. As the piston 106 moves in its reciprocating motion, friction between the piston 106 and the piston barrel 102 can cause the piston 106 and/or the piston barrel 102 to degrade. Operating the mud hammer 100 with drilling fluid increases the rate of this degradation. To help prevent this degradation, the wear sleeve 134 helps prevent contact between the piston 106 and the piston barrel 102. As the piston 106 moves, the wear sleeve 134 degrades rather than the (more expensive) piston 106 and/or the piston barrel 102. The wear sleeve 134 is constructed of a suitable wear resistant material, such as for example, tungsten, bizaloy, carbon, or diamond impregnated steel. The wear sleeve 134 is replaceable upon degrading to a wear limit at which the wear sleeve 134 is unable to prevent contact between the piston 106 and the piston barrel 102. In various instances, the wear sleeve 134 is constructed such that it lasts for about as long as the drill bit 108 (e.g., about 40 hours of continuous operation) during operation of the mud hammer 100 prior to the wear sleeve 134 and the drill bit 108 reaching their respective wear limits.

In instances in which the mud hammer 100 includes the valving set 132, the valving set 132 also moves in a reciprocating motion. In such instances, the mud hammer 100 can include the secondary wear sleeve 136 positioned between the valving set 132 and the piston barrel 102. To help prevent degradation of the valving set 132 and/or the piston barrel 102, the wear sleeve 136 helps prevent contact between the valving set 132 and the piston barrel 102. The description of the wear sleeve 134 applies equally to the secondary wear sleeve 136. The wear sleeves 134 and 136 therefore prolong the operational lifetime of the mud hammer 100 in light of the degradation-inducing effects of operating the mud hammer 100 with drilling fluid.

In some aspects, the mud hammer 100 includes the bypass tube 104. The bypass tube 104 is positioned through the piston 106. In some instances, the bypass tube 104 can be positioned through the valving set 132. In some instances, the bypass tube 104 is centred with respect to (e.g., positioned along a long axis of) the piston 106 and/or the piston barrel 102. In some aspects, the bypass tube 104 has an inner diameter of between about two and three inches (about 5.08 to 7.62 centimetres). The bypass tube 104 is in fluid communication with the drill bit 108 (e.g., at an interface 118) such that drilling fluid can be delivered to the drill bit 108 through the bypass tube 104. The mud hammer 100 is configured such that a metered portion of drilling fluid delivered to the mud hammer 100 is directed through the bypass tube 104, while a remaining portion of the delivered drilling fluid is pushed under pressure into the mud hammer 100 to operate the mud hammer 100. For example, from the flow 14 of drilling fluid, the portion 16 of the flow 14 flows into the bypass tube 104, while the portion 18A and the portion 18B flow into the mud hammer 100. Metering the amount of drilling fluid that gets delivered to the drill bit face 120 through the bypass tube 104 helps prevent the high pressure cushion problem that can result when too much drilling fluid or mud is delivered to the drill bit face 120.

In various aspects, to control the metered flow into the bypass tube 104, the mud hammer 100 includes the valving set 130. The valving set 130 can be a single valve or adapter or can be multiple valves and/or adaptors. In some instances, the valving set 130 can be a component of the bypass tube 104. In other instances, such as the one illustrated in FIGS. 1 and 2, the valving set 130 can be positioned at the receiving end of the bypass tube 104. The valving set 130 can be configured to allow a set amount (e.g., the flow 16) of the drilling fluid 14 delivered to the mud hammer 100 (e.g., the flow 14) to pass into the bypass tube 104. In some instances, the set amount can be an amount that is less than 80% of the total delivered drilling fluid 14. In some instances, the set amount can be about 50% to 80% of the total drilling fluid 14 delivered. In some aspects, the valving set 130 can be non-adjustable such that it is configured to allow only a single set amount of drilling fluid into the bypass tube 104. In other aspects, the valving set 130 can be adjustable such that a drill operator can adjust the set amount of fluid that the valving set 130 is configured to allow to flow into the bypass tube 104. The valving set 130 can be adjustable in having a variable aperture or diaphragm therein that controls the amount of drilling fluid that can pass therethrough. In some embodiments the valving set 130 is one of a plurality of valving sets 130 that can be selected from a range of valve diameters. In such aspects, the adjustability provides drill operators with the ability to alter the amount of drilling fluid 14 delivered to the drill bit face 120 based on different drilling conditions and geology.

The mud hammer 100 includes the drill bit 108. In some aspects, the drill bit 108 can be coupled to the body of the mud hammer 100 such that it is removable. The drill bit 108 includes the drill bit face 120. The drill bit 108 includes the one or more exit ports 122A, 122B that enable drilling fluid 16 to exit at the drill bit face 120. The one or more exit ports 122A, 122B are in fluid communication with the bypass tube 104. The flow 16 of drilling fluid that travels through the bypass tube 104 exits at the drill bit face 120 as one or more exhaust flows 124A, 124B. The one or more exhaust flows 124A, 124B flush cuttings away from the drill bit 108 during operation of the mud hammer 100.

In some aspects, the body of the mud hammer 100 can include a drive sub that includes the drive sub 138 and a shroud 226 (as shown in FIG. 2). In such aspects, the drive sub 138 includes stabiliser wings. In some aspects, the drive sub can also include a suitable bit retention system for retaining the drill bit 108.

The piston barrel 102 of the mud hammer 100 includes the one or more exhaust ports 110A, 110B. These exhaust ports 110A, 110B are illustrated in FIG. 1, though it should be appreciated that in some embodiments the piston barrel 102 may include only a single exhaust port or more than two exhaust ports. For embodiments having a single exhaust port, the exhaust port can extend around any suitable portion of the piston barrel 102. After drilling fluid 18A,18B passes through the valving set 132 having operated the piston 106, the drilling fluid can exit the piston barrel 102 through the one or more exhaust ports 110A, 110B. The exhausted drilling fluid from the exhaust ports 110A, 110B is expelled in a direction (e.g., upwards during operation) away from the drill bit 108, as indicated by the exhaust flows 112A and 112B. Directing the exhaust flows 112A, 112B away from the drill bit 108 assists in flushing cuttings away from the drill bit 108.

FIG. 2 illustrates an exploded, perspective view of a mud hammer 200 according to an embodiment of the disclosure. The mud hammer 200 is configured to operate as described above in relation to mud hammer 100 where like features are similarly numbered. In various instances, the mud hammer 100 can include any of the components of the mud hammer 200, and vice versa. It should also be appreciated that the components illustrated in FIGS. 1 and 2 are not necessarily shown to scale. The mud hammer 200 can include a top sub 126. The mud hammer 200 includes the bypass tube 104. The valving set 130 is positioned at the receiving end of the bypass tube 104. In some instances, one or more o-rings 202 are positioned between the bypass tube 104 and the valving set 130. The mud hammer 200 includes the piston 106. In some instances, the mud hammer 200 can include the wear sleeve 134. The mud hammer 200 includes the piston barrel 102. In some instances, the mud hammer 200 can include a drive sub 138. The mud hammer 200 includes the drill bit 108.

Figure 3:
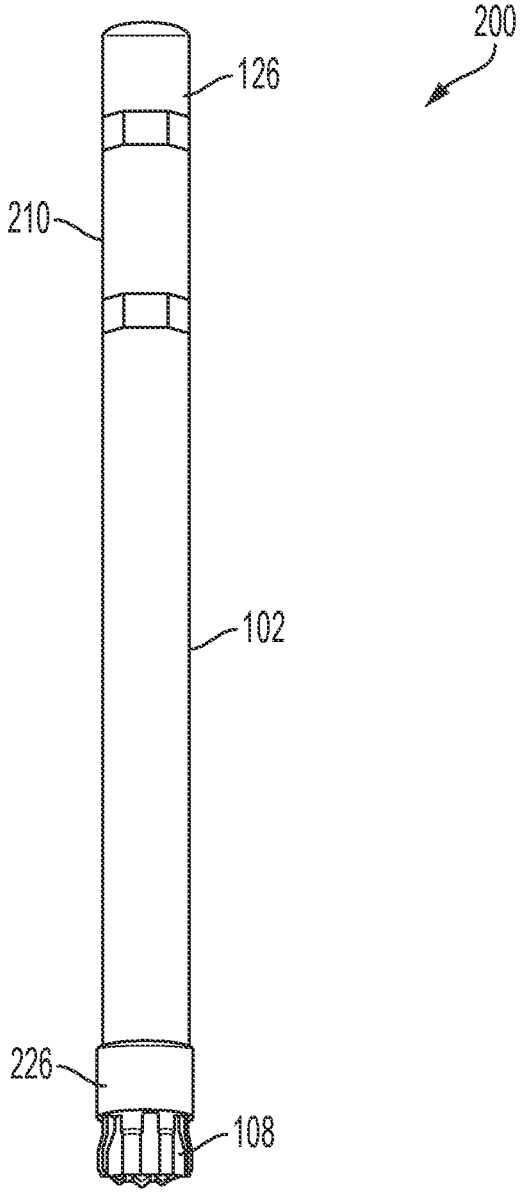
FIG. 3 illustrates a perspective view of the mud hammer shown in FIG. 2.

In various instances, the mud hammer 200 can include any suitable combination of the following components: one or more o-rings 204, a circlip 206, a distributor 208, a top barrel or sub 210, a check valve or plunger 211, a y-ring or check valve 212, a spring 214, a compression buffer 216, a bypass tube mount 218, a bearing bush 220, one or more bit stop rings 222 and 224, and a shroud 226. In some instances, the compression buffer 216 can be a ring, such as a steel ring. The check valve or plunger 211, the y-ring or check valve 212, the spring 214, and/or the compression buffer 216 can comprise the valving set 132. In some instances, the bearing bush 220 can be cold pressed. In some instances, the bit stop ring 222 can be an o-ring. FIG. 3 illustrates an assembled perspective view of the mud hammer 200 shown exploded in FIG. 2.

Figure 4:
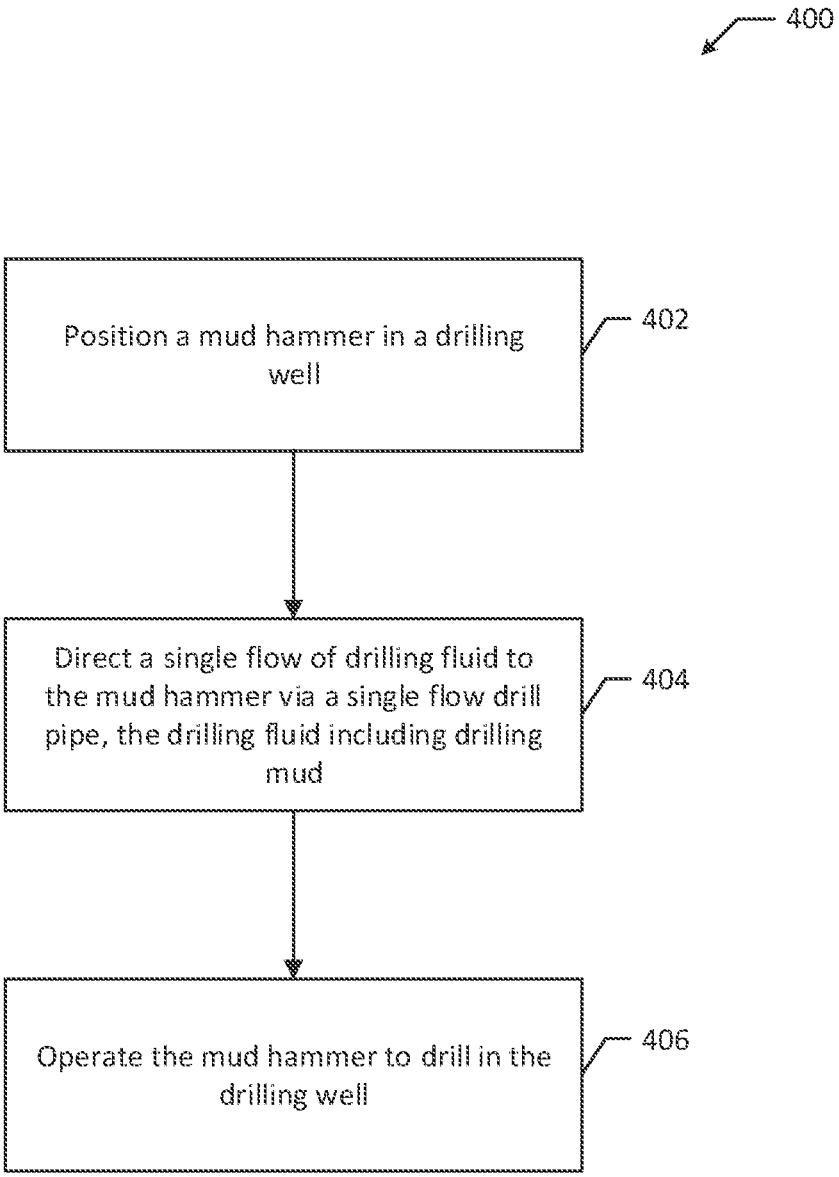
FIG. 4 illustrates a flow chart of a drilling method, according to an aspect of the present disclosure.

FIG. 4 illustrates a flow chart of a drilling method, according to an aspect of the present disclosure. Although the example method 400 is described with reference to the flowchart illustrated in FIG. 4, it will be appreciated that many other methods of performing the acts associated with the method 400 can be used. For example, the order of some of the blocks may be changed, certain blocks may be combined with other blocks, and some of the blocks described are optional.

The mud hammer 100, 200 can be positioned in a drilling well (block 402). The mud hammer 100,200 can be any of the described embodiments herein. The single flow of drilling fluid 14 can be directed to the mud hammer 100,200 via the single flow drill pipe 12 (block 404). The drilling fluid 14 includes drilling mud. The single flow drill pipe can be any suitable, standard API-certified drill pipe. In an example, the mud hammer 100,200 positioned in the drilling well is constructed to operate on drilling fluid, which enables directing the single flow of drilling fluid 14 to the mud hammer 100,200. This is in comparison to at least some typical DC fluid hammers, which require a dual circulation drill pipe system to separate drilling mud from clean water. At least some of such typical DC fluid hammers are unable to operate via a single flow drill pipe. Some typical DC fluid hammers can be adapted to operate via a single flow drill pipe, but such adaption results in an inefficient mud or fluid hammer as compared to the provided mud hammer 100,200 described herein.

The mud hammer 100,200 can then be operated to drill in the drilling well (block 406). In an example, of the single flow of drilling fluid 14 that is directed to the mud hammer 100,200, a set amount (e.g., between 50% and 80%) of drilling fluid flows into the bypass tube 104 of the mud hammer 100,200 during operation. In various instances, the drilling fluid 16 that flows into the bypass tube 104 exits the mud hammer 100,200 at the drill bit face 120. The remaining portion 18A,18B of the single flow of drilling fluid 14 can flow into the mud hammer 100, exteriorly to the bypass tube 104, to operate the mud hammer 100. In some aspects, the method 400 can further include replacing one or more wear sleeves (e.g., the wear sleeve 134 and/or the wear sleeve 136) of the mud hammer 100,200. In an example, the wear sleeve 134 and/or the wear sleeve 136 are replaced once they reach their respective wear limits. In an example, the wear sleeve 134 and/or the wear sleeve 136 are constructed such that their respective wear limits take about the same amount of time to reach as a wear limit of the drill bit 108 during operation of the mud hammer 100,200.

As used herein, "about," "approximately" and "substantially" are understood to refer to numbers in a range of numerals, for example the range of −10% to +10% of the referenced number, preferably −5% to +5% of the referenced number, more preferably −1% to +1% of the referenced number, most preferably −0.1% to +0.1% of the referenced number.

The terms "comprise", "comprises", "comprised" or "comprising", "including" or "having" and the like in the present specification and claims are used in an inclusive sense, that is to specify the presence of the stated features but not preclude the presence of additional or further features.

Furthermore, all numerical ranges herein should be understood to include all integers, whole or fractions, within the range. Moreover, these numerical ranges should be construed as providing support for a claim directed to any number or subset of numbers in that range. For example, a disclosure of from 1 to 10 should be construed as supporting a range of from 1 to 8, from 3 to 7, from 1 to 9, from 3.6 to 4.6, from 3.5 to 9.9, and so forth.

The examples and aspects disclosed herein are to be construed as merely illustrative and not a limitation of the scope of the present disclosure in any way. It will be apparent to those having skill in the art that changes may be made to the details of the above-described examples without departing from the underlying principles discussed. In other words, various modifications and improvements of the examples specifically disclosed in the description above are within the scope of the appended claims. For instance, any suitable combination of features of the various examples described is contemplated.

The invention claimed is:

1. A mud hammer comprising:

a piston barrel configured to receive a single flow of drilling fluid including drilling mud, the piston barrel including at least one exhaust port exhausting drilling fluid to an exterior of the mud hammer;

a piston positioned within the piston barrel and configured to move in a reciprocating motion operated by a first portion of the drilling fluid;

a bypass tube disposed through the piston and in fluid communication with a drill bit;

an adjustable valving set configured to divert a second portion of the drilling fluid into the bypass tube; and a wear sleeve positioned to prevent contact between the piston and the piston barrel;

wherein the second portion of the drilling fluid diverted into the bypass tube is exhausted from the drill bit and the first portion of drilling fluid operating the piston is exhausted from the piston barrel via the at least one exhaust port, away from the drill bit.

2. The mud hammer of claim 1, wherein the wear sleeve is constructed of a wear resistant material.

3. The mud hammer of claim 2, wherein the wear resistant material is at least one of tungsten, bizaloy, carbon, and diamond impregnated steel.

4. The mud hammer of claim 1, wherein the adjustable valving set is positioned at a receiving end of the bypass tube.

5. The mud hammer of claim 1, wherein the adjustable valving set is a component of the bypass tube.

6. The mud hammer of claim 1, further comprising a secondary valving set configured to direct the first portion of drilling fluid to generate the reciprocating motion of the piston.

7. The mud hammer of claim 6, wherein the bypass tube is positioned through the secondary valving set.

8. The mud hammer of claim 6, further comprising a secondary wear sleeve positioned to prevent contact between the secondary valving set and the piston barrel.

9. The mud hammer of claim 1, wherein an inner diameter of the bypass tube is between approximately two to three inches.

10. The mud hammer of claim 1, wherein the bypass tube is centred within the piston barrel.

11. The mud hammer of claim 1, further comprising a drive sub having at least one of the following: stabiliser wings, a shroud, and a bit retention system.

12. The mud hammer of claim 1, wherein the piston barrel comprises at least two exhaust ports configured to exhaust drilling fluid in an upwards direction, in use, away from the drill bit.

13. The mud hammer of claim 1, wherein the drill bit is a percussion drill bit.

14. The system of claim 1, wherein the piston has a stroke length between 20 to 60 millimetres.

15. The system of claim 1, wherein the piston cycles at a rate of between 10 to 25 cycles per second.

16. The system of claim 1, wherein the single flow drill pipe includes internal blow out prevention.

17. A system comprising:

a single flow drill pipe configured to deliver a single flow of drilling fluid including drilling mud;

a mud hammer in fluid communication with the single flow drill pipe, the mud hammer comprising:

a piston barrel including at least one exhaust port exhausting drilling fluid to an exterior of the mud hammer;

a piston positioned within the piston barrel and configured to move in a reciprocating motion operated by a first portion of the drilling fluid;

a bypass tube disposed through the piston and in fluid communication with a drill bit;

an adjustable valving set configured to divert a second portion of the drilling fluid into the bypass tube; and a wear sleeve positioned to prevent contact between the piston and the piston barrel, wherein the second portion of the drilling fluid diverted into the bypass tube is exhausted from the drill bit and the first portion of drilling fluid operating the piston is exhausted from the piston barrel via the exhaust ports, away from the drill bit.

18. The system of claim 17, wherein the piston has a stroke length between 20 to 60 millimetres.

19. The system of claim 17, wherein the piston cycles at a rate between 10 to 25 cycles per second.

20. The system of claim 17, wherein the single flow drill pipe includes internal blow out prevention.

21. A method of drilling comprising:

(a) positioning a mud hammer in a drilling well, the mud hammer comprising:

a piston barrel including at least one exhaust port configured to exhaust drilling fluid to an exterior of the mud hammer;

a piston positioned within the piston barrel and configured to move in a reciprocating motion operated by a first portion of a drilling fluid;

a bypass tube positioned through the piston and in fluid communication with a percussion drill bit, the drill bit having a drill bit face;

an adjustable valving set configured to divert a second portion of the drilling fluid into the bypass tube; and a wear sleeve positioned to prevent contact between the piston and the piston barrel;

(b) directing a single flow of the drilling fluid to the mud hammer via a single flow drill pipe, the drilling fluid including drilling mud; and (c) operating the mud hammer to drill in the drilling well, wherein the second portion of the drilling fluid diverted into the bypass tube is exhausted from the drill bit at the drill bit face and the first portion of drilling fluid operating the piston is exhausted from the piston barrel via the at least one exhaust port, away from the drill bit.

22. The method of claim 21, wherein the second portion of the drilling mud is between 50% to 80% of a total volume of drilling fluid delivered to the mud hammer.

23. The method of claim 21, wherein the drilling fluid is delivered to the mud hammer under pressure.

24. The method of claim 21, wherein the single flow of drilling fluid is directed to the mud hammer at a rate of about 800 gallons per minute to 1,000 gallons per minute.

* * * * *